United States Patent [19]

Moen

[11] 4,275,843

[45] Jun. 30, 1981

[54] AUTOMATICALLY ADJUSTABLE SHOWER HEAD

[75] Inventor: Alfred M. Moen, Grafton, Ohio

[73] Assignee: Stanadyne, Inc., Windsor, Conn.

[21] Appl. No.: 94,293

[22] Filed: Nov. 14, 1979

[51] Int. Cl.[3] ..... B05B 1/26

[52] U.S. Cl. ..... 239/499; 239/570; 239/587

[58] Field of Search ..... 239/587, 570, 498, 499, 239/460, 453, 553, 553.5; 138/45, 46

[56] References Cited

U.S. PATENT DOCUMENTS

| | | | |
|---|---|---|---|
| 2,583,233 | 1/1952 | Russell | 299/59 |
| 2,680,043 | 6/1954 | Campbell | 299/59 |
| 2,680,649 | 6/1954 | Hansen | 299/59 |
| 2,688,515 | 9/1954 | Filliung | 299/59 |
| 2,990,123 | 6/1961 | Hyde | 239/459 X |
| 2,991,016 | 7/1961 | Allenbaugh, Jr. | 239/458 |
| 3,130,991 | 4/1964 | Billeter | 239/109 |
| 3,150,829 | 9/1964 | Specht et al. | 239/107 |
| 3,189,284 | 6/1965 | Downey | 239/587 X |
| 3,421,701 | 11/1969 | Walters | 239/453 |
| 3,539,112 | 11/1970 | Thompson | 239/452 |
| 3,684,192 | 8/1972 | McMillan | 239/452 |
| 3,697,002 | 10/1972 | Parkison | 239/570 X |
| 3,863,844 | 2/1975 | McMillan | 239/452 |
| 3,948,285 | 4/1976 | Flynn | 137/494 |
| 3,997,116 | 12/1976 | Moen | 239/587 X |
| 4,079,762 | 3/1978 | Hanson, Jr. | 141/286 |
| 4,082,225 | 4/1978 | Haynes | 239/428.5 |

*Primary Examiner*—Robert B. Reeves
*Assistant Examiner*—Gene A. Church
*Attorney, Agent, or Firm*—Kinzer, Plyer, Dorn & McEachran

[57] ABSTRACT

An automatic pressure responsive shower head includes an outer housing and a body member positioned within the housing and attached thereto. The body member has a water discharge at one end and is connected to a swivel member at the other end. There are water passage means within the body member between the swivel member and the body member water discharge. A water pressure responsive control member is positioned within the body member and is effective to control the flow of water through the body member water passage.

2 Claims, 5 Drawing Figures

Fig. 1.
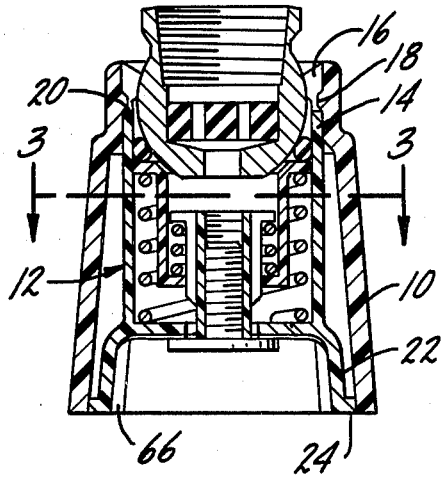
Fig. 2.
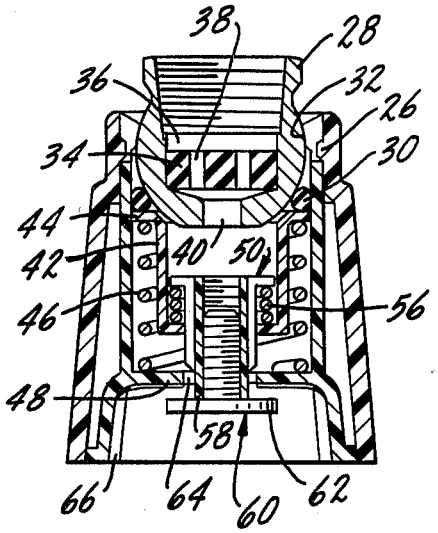
Fig. 3.
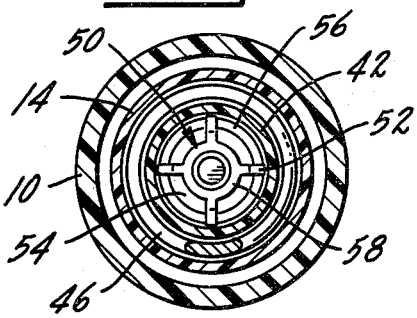
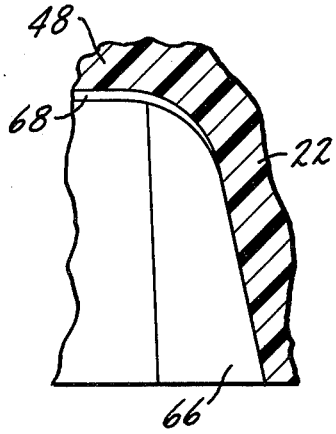
Fig. 4.
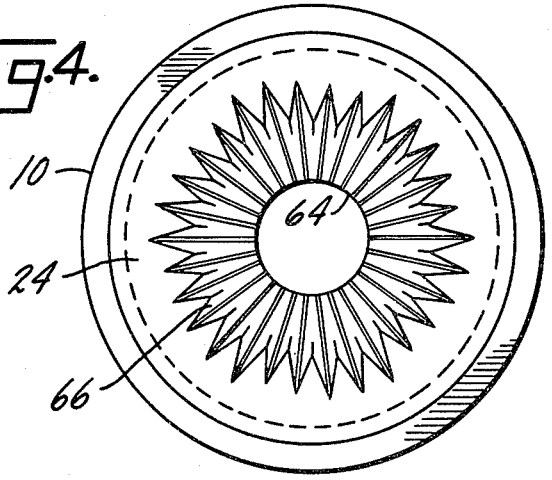
Fig. 5.

AUTOMATICALLY ADJUSTABLE SHOWER HEAD

SUMMARY OF THE INVENTION

The present invention relates to shower heads and in particular to a shower head which adjusts the water jet size in accordance with water pressure so as to provide a generally constant spray for the user.

Another purpose is a simply constructed reliably operable shower head of the type described in which the jet size automatically adjusts in accordance with water pressure.

Another purpose is a shower head which provides a relatively constant shower spray for the user, regardless of water pressure.

Another purpose is a shower head of the type described using a pair of coiled springs, one of which assists in attaching the body of the shower head to a swivel member, with the other urging a control member toward a flow reducing position.

Other purposes will appear in the ensuing specification, drawings and claims.

BRIEF DESCRIPTION OF THE DRAWINGS

The invention is illustrated diagrammatically in the following drawings wherein:

FIG. 1 is an axial section through a shower head of the type described,

FIG. 2 is an axial section, similar to FIG. 1, but showing the water pressure control member in the full open position, FIG. 3 is a section along plane 3—3 of FIG. 1, FIG. 4 is a bottom view of the shower head illustrating the spray forming grooves therein, and FIG. 5 is an enlarged partial side view of a spray forming groove.

DESCRIPTION OF THE PREFERRED EMBODIMENT

In the drawings, an outer housing is indicated generally at 10 and may be either a solid metal member or it may be a plastic member with a suitable outer metallic or chrome coating. Basically, housing 10 is decorative in nature. Positioned within housing 10 is a body member 12 which has a cylindrical portion 14 and an upper outwardly extending flange area 16 separated from the cylindrical portion 14 by a groove 18. There are a plurality of notches, generally uniformly spaced and indicated at 20, which pass through flange 16 and extend down into the area of groove 18. The lower end or outer end of body member 12 includes a somewhat flared skirt 22 and an outwardly extending flange 24 at its lower end, which flange is in contact with and positions the outer end of housing 10. As particularly shown in FIGS. 1 and 2, there is an inwardly directed annular rim or bead 26 on housing 10 which extends within groove 18 on body member 12 to thereby attach the body member to the outer housing. The body member is preferably of plastic, as it is necessary that the attaching flange be somewhat flexible so that the housing 10 may be slid over and then snapped upon the body member.

Body member 12 is attached to a conventional ball or swivel member 28. The attachment may conveniently be formed by an O-ring 30 positioned on one side of the swivel member horizontal diameter and by an interior surface 32 of flange 16 which is positioned at the other side of the swivel member horizontal diameter. O-ring 30 is held in position by a retainer, as described hereinafter. The flexible nature of the plastic body member, and particularly flange 16 which is separated into sections by notches 20, permits the swivel to be pushed down into the body member and held firmly between O-ring 30 and attaching flange 16.

The swivel member may have an interior flow control washer or seal member 34 which is positioned within a cavity 36 in the swivel member and itself has a plurality of water control passages 38. The flow control washer 34 is made of a distortable material, such as rubber or a similar elastomeric, and has the ability to distort under water pressure thereby providing some water control function. Swivel member 28 has a water passage 40 which is in communication with the interior of the body member to thereby direct incoming water into the body member and ultimately out through its discharge toward the user.

A cup-shaped retainer 42 is positioned in axial alignment with passage 40 and has an outwardly-extending flange 44 which supports O-ring 30. A coil spring 46 encircles retainer 42 with the lower coil being seated upon a body member partition 48, enabling the spring, through retainer 42, to provide an upwardly-directed bias upon seal ring 30, thus to maintain the seal ring in position and the body member attached to the swivel.

Positioned within retainer 42 and extending through a central passage 51 therein is a nut 50, the upper end of which has four generally uniformly spaced outwardly extending flanges 52 which define annular water passages 54 therebetween. A small coil spring 56 is bottomed upon the lower surface of retainer 42 and exerts an upward bias upon flanges 52, as particularly shown in FIGS. 1 and 2. Thus, the nut 50 is normally urged toward the position of FIG. 1. This is a sleeve 58 held within nut 50 and a screw 60 is threadedly engaged with the sleeve. The lower end of the screw has a flat control member 62 which is effective to control the flow of water passing through partition passage 64. Sleeve 58 and the shank portion of screw 60 extend through passage 64 with control member 62 being outside of or exteriorly of water passage 64.

The skirt-shaped portion 22 of body member 12 has a series of grooves 66 of varying depth, shown particularly in FIG. 4, which are effective to form a series of individual sprays, each at a different angle relative to the shower head. The grooves extend not only in the skirt portion of the body member, but also extend along the bottom surface of partition 48, as indicated at 68 in FIG. 5. Thus, the position of the control member 62 will control the amount of water passing into the grooves, but there can never be a total shutoff of water flow since the grooves are each in communication with water passage 64.

In operation, when the shower head is not in use, the control member will be in the position of FIG. 1. As water begins to flow, and depending upon the pressure of the water, the control member will move away from the bottom surface of partition 48. The degree to which the control member will move from the position of FIG. 1 is determined by water pressure, as pressure upon the top of nut 50 and upon member 62 will cause it to move against the force of spring 56, compressing the spring as shown in FIG. 2, so that the control member moves in an outward direction. As pressure increases and the control member moves toward an open position, the jet diameter will increase as more water is flowing through passage 64 and into grooves 66. However, with an increase in jet diameter caused by an increase in supply pressure, there is a consequent reduction in jet velocity. Thus, the sensation or feel of the shower on the user remains relatively constant. At lower pressures the jet velocity is higher and even though there is effectively more water at higher pressure, the user has the same feel regardless of water pressure. When the control member is in the fully closed position of FIG. 1, there is still a useful supply of water to the spray forming grooves 66 and thus, even under low pressure, there is an adequate supply of water for a shower and the sensation or feel of the shower is essentially the same as in a fully open position, as illustrated in FIG. 2. The structure shown herein will satisfactorily operate over a range of 1–3 gallons per minute with no adjustment by the user and with essentially the same sensation or feel to the user.

Of particular importance is the reliably compact structure wherein the control member is yieldingly urged to a flow reducing position with the body member partition water passage and the body member in turn is fastened to the swivel by the spring-biased retainer. The structure can be inexpensively manufactured out of plastic parts and easily assembled with reliability.

Whereas the preferred form of the invention has been shown and described herein, it should be realized that there may be many modifications, substitutions and alterations thereto.

The embodiments of the invention in which an exclusive property or privilege is claimed are defined as follows:

1. An automatic pressure-responsive shower head including an outer housing, a body member within the housing, said body member including a generally cylindrical portion and an outwardly-flared skirt at one end, said body member being in contact with said housing at one end of said cylindrical portion and at the outer periphery of said skirt, a partition across said body member at the junction of said skirt and cylindrical portion, a swivel member and means for attaching it to said body member including a flexible body member flange positioned against said swivel member on one side of a diameter and a seal ring positioned between said body member and swivel on the other side of the same diameter, a cup-shaped retainer having an outwardly-flared end positioned within said body member, a spring seated on said partition and urging said flared end against said seal member, a water passage in said body member partition in communication with said swivel member through an aligned opening in said retainer, a control member extending through the aligned openings in said partition and retainer and having an enlarged head outside of said body member partition to perform a water control function therewith, said control member having outwardly-extending flange means with spaces therebetween, a spring seated on said retainer and acting against said flange means to urge said control member head toward said partition, the spaces between said control member flange means providing water communication between said swivel and said body member partition water passage, water flowing from said swivel toward said control member urging said enlarged head away from said body member partition water passage.

2. The structure of claim 1 further characterized in that the interior surface of said body member skirt includes a plurality of spray forming grooves, said spray forming grooves being in constant communication with said body member partition water passage, regardless of the position of said control member enlarged head, thereby providing for a constant, although variable, flow of water from said body member partition water passage to said spray forming grooves.

* * * * *